US008129005B2

(12) United States Patent
Boskus et al.

(10) Patent No.: US 8,129,005 B2
(45) Date of Patent: Mar. 6, 2012

(54) SYNTHETIC ICE SURFACES AND METHODS

(75) Inventors: Perry Boskus, Clearwater, FL (US); Tom Rios, Clarkesville, GA (US)

(73) Assignee: Florida Skating, Inc., Clearwater, FL (US)

( * ) Notice: Subject to any disclaimer, the term of this patent is extended or adjusted under 35 U.S.C. 154(b) by 343 days.

(21) Appl. No.: 12/556,975

(22) Filed: Sep. 10, 2009

(65) Prior Publication Data

US 2011/0059283 A1 Mar. 10, 2011

(51) Int. Cl.
*B32B 3/10* (2006.01)
*A63C 19/10* (2006.01)

(52) U.S. Cl. ..... 428/33; 428/44; 428/46; 428/53

(58) Field of Classification Search ..... 428/44, 428/46, 48, 33, 53; 472/90; 404/41, 35; 52/590.2, 590.1, 590.3, 177
See application file for complete search history.

(56) References Cited

U.S. PATENT DOCUMENTS

| | | | | |
|---|---|---|---|---|
| 3,771,891 | A * | 11/1973 | Nirenski et al. | 404/40 |
| 6,032,427 | A | 3/2000 | Randjelovic | |
| 6,139,438 | A | 10/2000 | Park et al. | |
| D481,138 | S | 10/2003 | Forster et al. | |
| 7,270,497 | B2 * | 9/2007 | Von Langsdorff | 404/39 |
| 7,347,788 | B2 | 3/2008 | Smith, II | |

* cited by examiner

*Primary Examiner* — Alexander Thomas
(74) *Attorney, Agent, or Firm* — Harvey S. Kauget; Phelps Dunbar LLP

(57) ABSTRACT

The present invention discloses a synthetic ice surface system comprising a first synthetic ice panel having a top surface, a bottom surface, and a side surface having at least one expansion groove having a length dimension and a height dimension, a second synthetic ice panel having a top surface, a bottom surface, and a side surface having at least one expansion nub having a length dimension and a height dimension, wherein the expansion groove is disposed along the side surface of the first synthetic ice panel so as to engage with the expansion nub on the side surface of the second synthetic ice panel such that the movement of the first synthetic ice panel relative to the second synthetic ice panel is inhibited.

6 Claims, 5 Drawing Sheets

SYNTHETIC ICE SURFACES AND METHODS

FIELD OF THE INVENTION

The present invention generally relates to synthetic ice surfaces and methods for producing the same.

BACKGROUND OF THE INVENTION

Synthetic ice surfaces are used in a variety of environments and offer distinct advantages over natural ice. Synthetic surfaces can be installed indoors or outdoors and do not require the same level of upkeep or constant refrigeration required of natural ice. This leads synthetic ice surfaces to be usable year round and in climates where natural ice surfaces would be impractical to install and/or maintain.

A typical synthetic ice surface consists of a plurality of panels installed over a sub-floor or directly onto the ground if the environmental conditions are acceptable for installation. Given that synthetic ice surfaces inherently have seams where the panels are joined, it is important to have panels which fit as tightly as possible in order to prevent accidents which may occur if a skating blade becomes caught in a seam. Seams are not an issue with natural ice as once the rink surface panels are installed, the frozen surface is formed on top of the panels resulting in a seamless surface. Given that synthetic ice surfaces can be installed outdoors in varying climates they are likely to experience expansion and contraction according to the season, location and time of day in which skating activities take place. Expansion and contraction of seam joints is undesirable as it can lead to the opening of the panel seams and risk catching a skating blade during use of the surface. Thus, there is a need to design a synthetic ice surface panel whose seam joints are resistant to expansion and contraction.

Prior attempts to design synthetic ice surface panels have been made. Typically, these solutions employ various mechanisms or devices to engage with the panels and maintain each panel in close proximity to the other. These systems, while effective, require the installation of additional parts and complicate the fabrication process of the panels themselves. Thus, there is a need for a synthetic ice surface panel having an integrated expansion control system without reliance on additional parts for maintaining the integrity of the synthetic ice surface once installed.

BRIEF SUMMARY OF THE INVENTION

The present invention discloses a synthetic ice surface system comprising a first synthetic ice panel having a top surface, a bottom surface, and a side surface having at least one expansion groove having a length dimension and a height dimension, a second synthetic ice panel having a top surface, a bottom surface, and a side surface having at least one expansion nub having a length dimension and a height dimension, wherein the expansion groove is disposed along the side surface of the first synthetic ice panel so as to engage with the expansion nub on the side surface of the second synthetic ice panel such that the movement of the first synthetic ice panel relative to the second synthetic ice panel is inhibited.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

Similar reference characters refer to similar parts throughout the several views of the drawings.

DETAILED DESCRIPTION OF THE INVENTION

Figure 1:
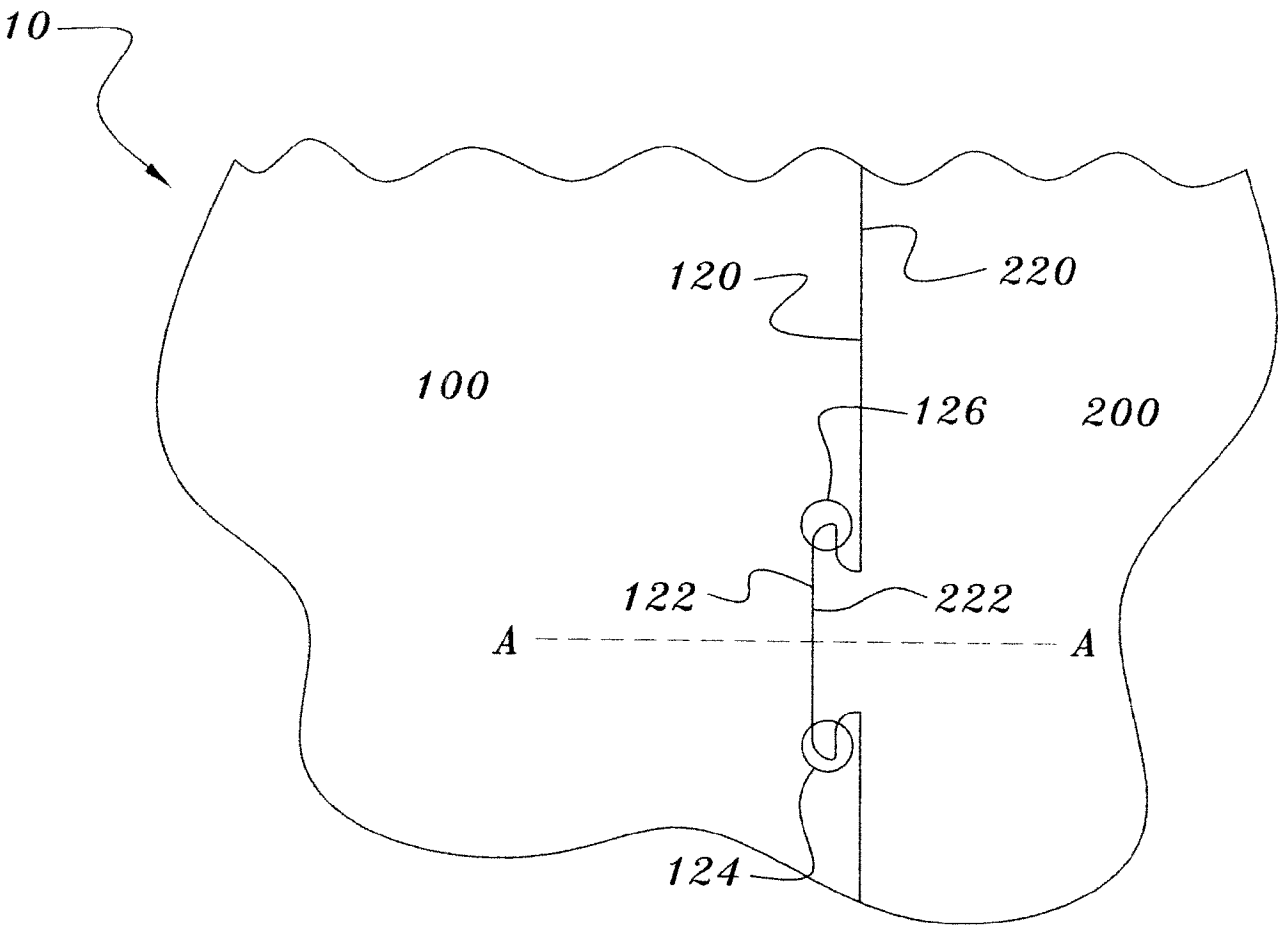
FIG. 1 is a partial view of a two panel embodiment of the present invention.

Referring now to the drawings, the synthetic ice surface system of the present invention is described. FIG. 1 illustrates a typical synthetic ice surface 10 comprising two panels 100 and 200 according to the present invention. As understood by one skilled in the art, the overall size of the assembled synthetic ice surface 10 can be of any dimension, however for illustrative purposes a two panel synthetic ice surface is sufficient to illustrate the present system without undue repetition. As shown in FIG. 1, the assembled synthetic ice panel 10 consists of two panels, Panel 100 and Panel 200. As understood by one skilled in the art, each panel necessarily has a top surface intended for use as a skating surface and a bottom surface which contacts the ground, subfloor or other surface upon which the synthetic ice surface 10 is constructed. The outer perimeter of Panel 100 and Panel 200 can be of any desired geometric shape. In a preferred embodiment, the outer perimeter of the overall synthetic ice surface is smooth, however it is possible that the surface could be prepared in a variety of ways in order to facilitate the attachment of accessories (i.e., hockey style boards, fencing, etc.). In a preferred embodiment, each of Panel 100 and Panel 200 panel will necessarily have a side surface designed to mate with the other respective panel as described herein. For example in FIG. 1, Panel 100 has side surface 120 and Panel 200 has side surface 220 which are (in this example) straight and designed to provide close engagement between Panel 100 and Panel 200.

In a preferred embodiment, side surface 120 of Panel 100 contains at least one female dovetail cutout 122. Female dovetail cutout 122 is preferably in the shape of a female dovetail receptacle consisting of two flanged extremities, 124 and 126. The geometric outline of flanged extremities 124 and 126 can be of any configuration (i.e. angled, rounded, etc.) necessary to maintain Panel 100 and Panel 200 in close fixed proximity once female dovetail cutout 122 receives male dovetail 222 located on side surface 220 of Panel 200. Male dovetail 222 is preferably designed to match the interior outline and shape of female dovetail cutout 122 so as to effect a tight fit between Panel 100 and Panel 200 and restrict the lateral movement of Panel 100 relative to Panel 200.

Figure 2:
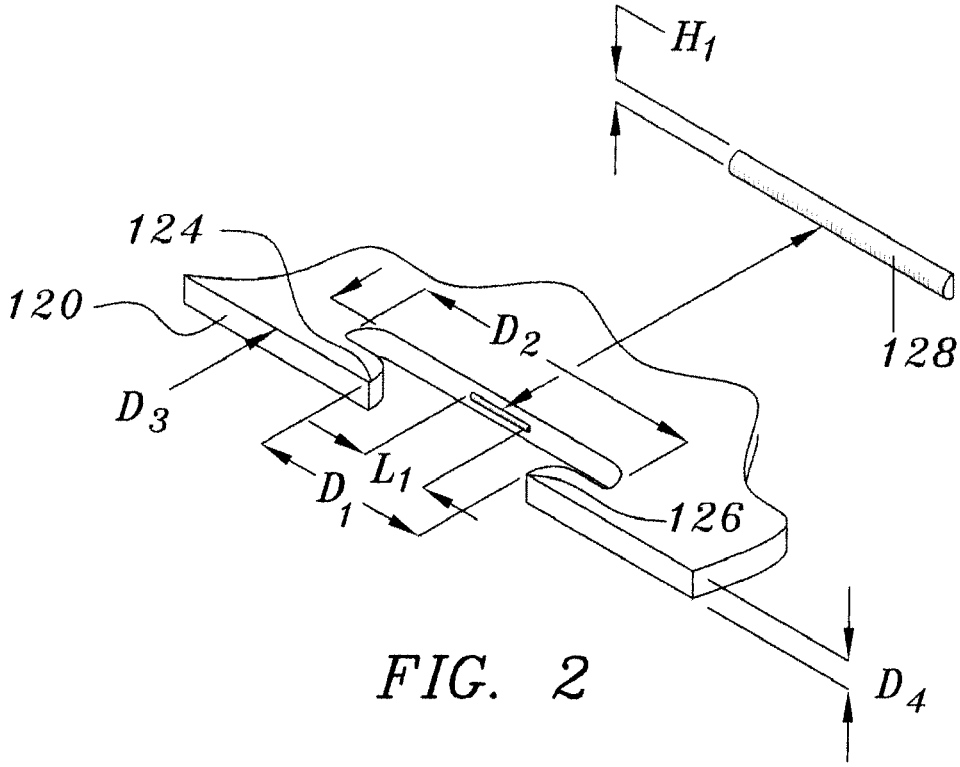
FIG. 2 is a close up view of a cutout contemplated by the present invention.

FIG. 2 illustrates a close up view of female dovetail cutout 122 without male dovetail 222 installed. Female dovetail cutout 122 is located along side surface 120 and is defined by an opening dimension $D_1$, a terminal dimension, $D_2$ and a depth dimension $D_3$. The width $D_4$ of female dovetail cutout 122 is equal to the width of Panel 100. Flanged extremities 124 and 126 are located at the outer limit of terminal dimension $D_2$. Additionally, it is preferred that the difference between opening dimension $D_1$ and terminal dimension $D_2$ be enough to provide sufficient gripping surface for male dovetail 222 to engage with female dovetail cutout 122. For example, if opening dimension $D_1$ and terminal dimension $D_2$ are equal, female dovetail cutout 122 would lose its dovetail characteristics and be unable to sufficiently retard the lateral movement of Panel 100 relative to Panel 200 when joined with male dovetail 222.

In a preferred embodiment female dovetail cutout 122 further contains an expansion nub 128 located along the terminal dimension $D_2$. Expansion nub 128 can take various geometric or non-geometric shapes. In a preferred embodiment as illustrated in FIG. 2, expansion nub 128 has a circumference with the length dimension $L_1$ and a height dimension $H_1$. In a preferred embodiment, expansion nub 128 can have an oblong circumference. Height dimension $H_1$ is necessarily restricted by the width $D_4$ of Panel 100. Similarly, length dimension $L_1$ is necessarily restricted by the size of terminal dimension $D_2$. In application, length dimension $L_1$ can be any size up to and including the length of terminal dimension $D_2$ however in preferred embodiments, length dimension $L_1$ is selected based on a comparative ratio of length dimension $L_1$ to height dimension $H_1$. $L_1$:$H_1$ ratios of 5:1 are preferred with 3.3:1 being most preferred. In a preferred embodiment, expansion nub 128 is molded as part of panel 100 at the time of manufacture, and is formed by the removal of surrounding material leaving expansion nub 128 remaining following this machining.

Figure 3:
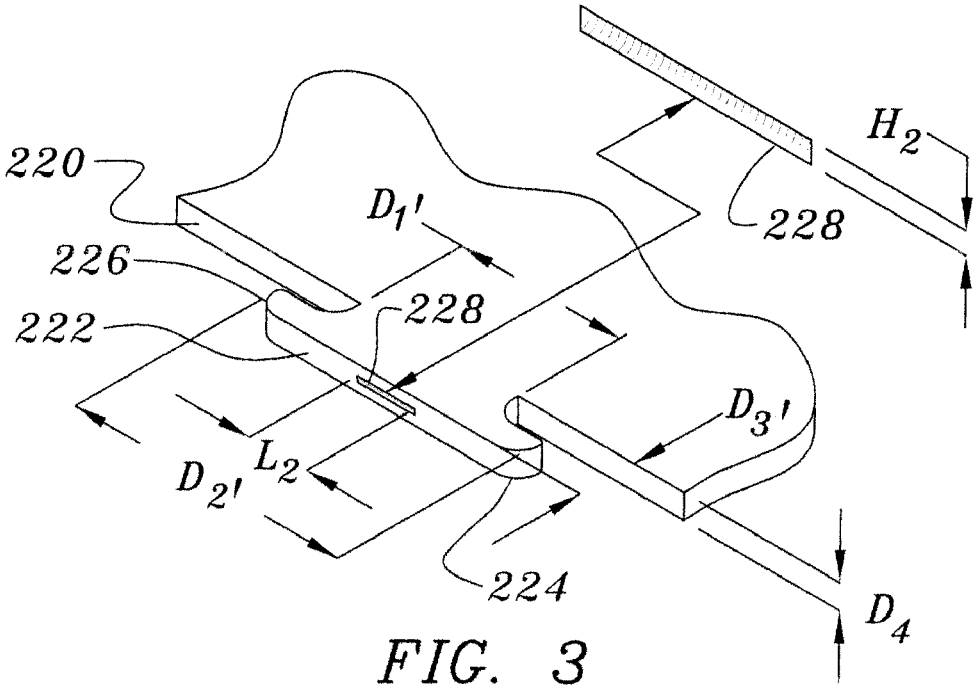
FIG. 3 is a close up view of a male dovetail as contemplated by the present invention.

FIG. 3 illustrates a close up view of male dovetail 222 prior to engagement with female dovetail cutout 122. Male dovetail 222 is located along side surface 220 of panel 200 and is defined by a terminal dimension $D_{2'}$, an inner dimension, $D_{1'}$, and a depth dimension $D_{3'}$. The width $D_4$ of male dovetail 222 is equal to the width of Panel 200. At opposing ends of terminal dimension $D_{2'}$ are dovetail points 224 and 226. In a preferred embodiment terminal dimension $D_{2'}$ will be equal to or slightly less than terminal dimension $D_2$ of female dovetail cutout 122. Likewise, it is preferred that inner dimension $D_{1'}$ be equal to or slightly less than opening dimension $D_1$, and depth dimension $D_{3'}$ be equal to or slightly less than depth dimension $D_3$. As is understood by one skilled in the art, the selection and sizing of female dovetail cutout 122 and male dovetail 222 should be such to provide a tight fit between panel 100 and panel 200.

In a preferred embodiment, male dovetail 222 further comprises an expansion groove 228. Expansion groove 228 is located along the side surface 220 of panel 200, specifically at some point along terminal dimension $D_{2'}$. Expansion groove 228 can be of any size or shape, however in a preferred embodiment the shape of expansion groove 228 will be influenced by the overall size and shape of expansion nub 128. That is to say the overall dimensions of expansion groove 228 should be selected to permit expansion nub 128 to engage within expansion groove 228 once male dovetail 222 is engaged with female dovetail cutout 122. Expansion groove 228 has an overall height $H_2$ and an overall length $L_2$. In a preferred embodiment, expansion groove 228 is oblong in circumference and extends into side surface 220 a sufficient distance to permit side surface 120 and side surface 220 to mate in a flush manner when male dovetail 222 engages with female dovetail cutout 122. In typical synthetic ice panels made from plastics or other such materials, expansion groove 228 can be created during the manufacturing process or after panel 220 is completed by other methods known in the art such as routing, grinding and the like.

Figure 4:
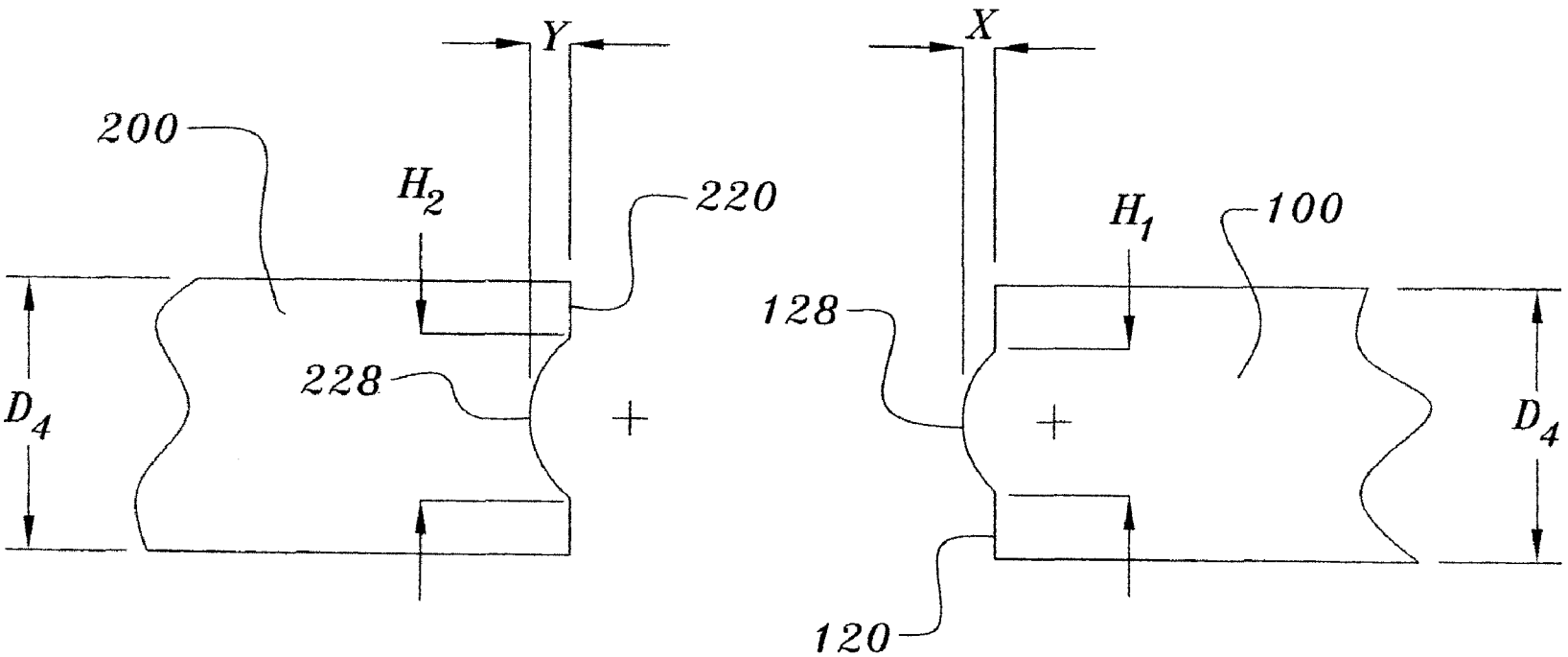
FIG. 4 is a cross sectional view of the engagement between an expansion protrusion and expansion groove taken along the line A-A of FIG. 1.

FIG. 4 is a cross sectional view illustrating the alignment of expansion nub 128 with expansion groove 228 taken along the line A-A of FIG. 1. In a preferred embodiment panel 100 and panel 200 each have a width equal to $D_4$. The actual dimension of width $D_4$ can be selected from any number of options depending on such factors as intensity of use of the synthetic ice panel, whether the panels will be installed indoors or outdoors, etc. In typical applications, width $D_4$ is between 0.25-1.50 inches with widths of 0.50-1.00 inches being preferable. As shown in FIG. 4, expansion nub 128 extends from side surface 120 a maximum distance X. Expansion groove 228 recesses into side surface 220 a maximum distance Y. Distance X can be chosen from amongst any number of distances, however it is preferable that distance X be less than distance Y in order to allow side surface 120 and side surface 220 to engage in a flush manner. Additionally, in some embodiments distance Y is greater than distance X in order to provide additional space for expansion of panel 100 and panel 200 whilst still maintaining a flush fit between side surface 120 and side surface 220. In application, preferred embodiments contemplate distance X ranging in size from 0.01-0.05 inches with 0.02 inches being preferred. Additionally, preferred embodiments envision distance Y ranging from 0.02-0.08 inches with a range of between 0.030-0.065 inches being most preferred.

With regard to the respective vertical heights of expansion nub 128 and expansion groove 228 a similar approach to that taken with horizontal displacement is preferred. Expansion nub 128 has a height $H_1$ which can be selected from any number of heights and is only limited by the width $D_4$ of panel 100. In a preferred embodiment utilizing panels which are 0.50 inches thick, height $H_1$ is chosen from a range of 0.140-0.180 with 0.149 being preferred. Similarly, the height $H_2$ of expansion groove 228 can be selected from a range of heights, but is preferably selected to be equal to or greater than $H_1$ in order to provide expansion room for any expansion of panel 200 relative to panel 100. In a preferred embodiment using panels which are 0.50 inches thick, height $H_2$ is chosen from a range of 0.185-0.235 with 0.185 being preferred.

Once female dovetail cutout 122 and male dovetail 222 are engaged, the resulting panel 10 provides a uniform surface which is needed for skating. The implementation of expansion nub 128 and expansion groove 228 facilitate the maintenance of a seamless panel 10 in varying environmental conditions. While the joint formed by female dovetail cutout 122 and male dovetail 222 is designed to maintain panel 100 in the same horizontal plane as panel 200, such a configuration on its own does not adequately restrict the vertical movement of panel 100 relative to panel 200 in the event of a change in environment or other expansion or contraction inducing event. The engagement of expansion nub 128 with expansion groove 228 reduces the tendency of panel 100 to shear relative to panel 200 in the event of expansion or contraction. Expansion nub 128 is preferably sized in order to withstand the weighted load of individuals skating on panel 10 and will maintain a smooth seamless panel 10 even in adverse environmental conditions which cause panel 100 and/or panel 200 to expand or contract. It will also be appreciated that although the embodiment described herein contemplates expansion nub 128 being located within female dovetail cutout 122 and expansion groove 228 being located within male dovetail 222, it is within the scope of this invention to reverse the orientation of expansion nub 128 and expansion groove 228 relative to female dovetail cutout 122 and male dovetail 228.

Figure 5:
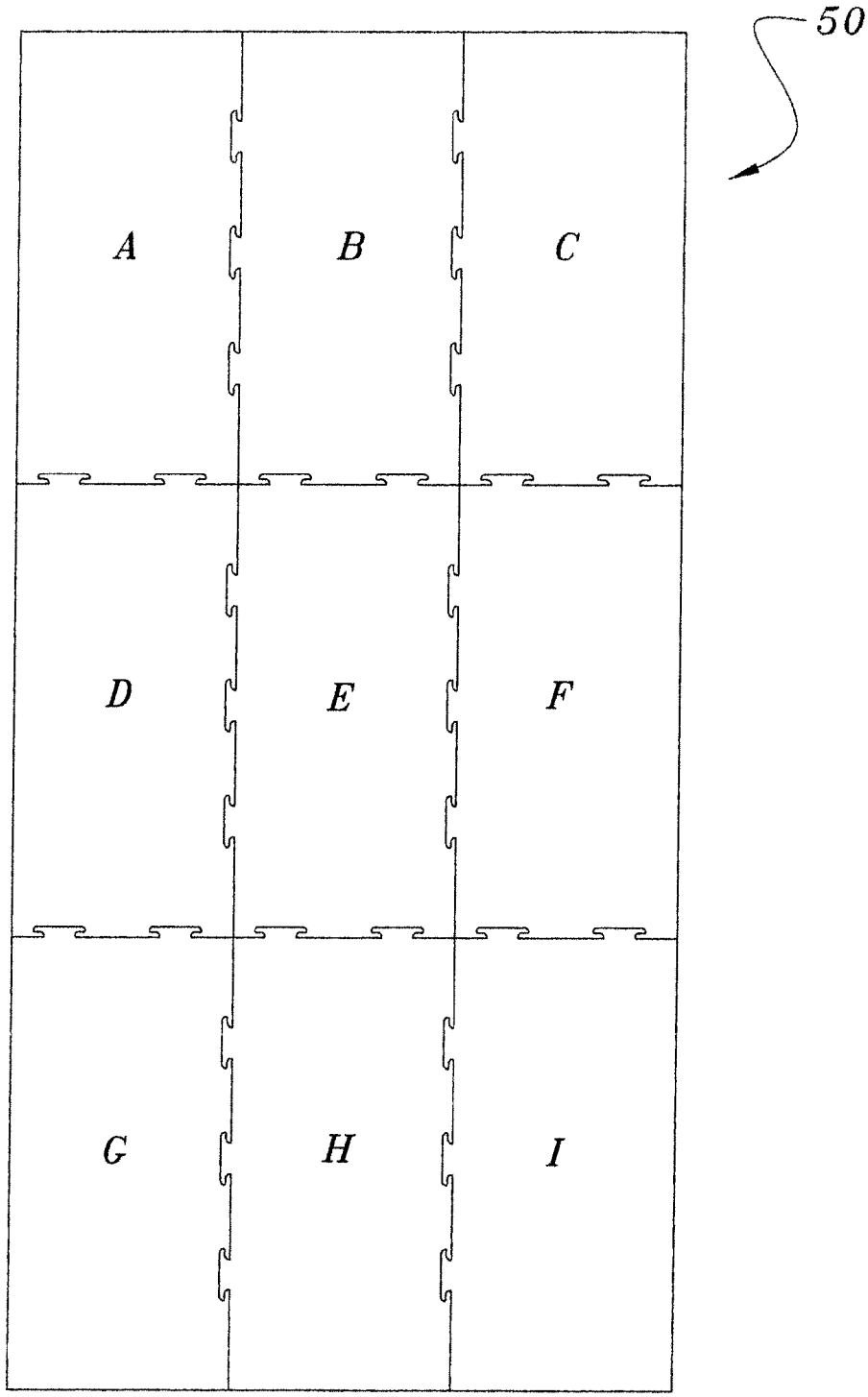
FIG. 5 is an illustration of a nine-panel embodiment of a synthetic ice surface according to the present invention.

FIG. 5 illustrates a synthetic ice surface 50 utilizing nine separate panels. Panel A-Panel I. Although the synthetic ice surface 50 of FIG. 5 is comprised of nine panels any number of panels can be employed in accordance with the present invention depending on the overall desired surface size. As shown in FIG. 5, the outer perimeter of the synthetic ice surface 50 is smooth and uniform due to each outer panel, i.e., Panel A-Panel D and Panel F-Panel I having one or more sides which are smooth and do not contain cutouts or male dovetails. Such a design provides an aesthetically pleasing and less obstructed outer perimeter, however, it is also contemplated by this invention to produce a synthetic ice surface 50 employing panels wherein each panel has cutouts or male dovetails on each side surface and end surface. Producing panels with cutouts and male dovetails on all side and end surfaces allows for a simpler manufacturing process as there are fewer required types of panels to be produced. For example, in FIG. 5, there are nine panels, each of which can only be placed in one location (provided that only one top surface is prepared for skating). It is also contemplated by the present invention to treat both top and bottom surfaces of each panel such that a panel's top and bottom surfaces are suitable for skating once installed. Treating both surfaces permits a wider range of installation locations for each individual panel.

As shown in FIG. 5 each side surface and end surface of each of Panel A-Panel I which engages with another panel has one or more cutouts and/or male dovetails. For example, Panel A as shown has two cutouts on the side surface which will engage with Panel B and one cutout on the end surface which will engage Panel D along with one smooth side surface and one smooth end surface. Each pair of cutouts/male dovetails contains the expansion protrusion and expansion groove as shown in detail in FIG. 4. Likewise, as Panel E engages with Panel B, Panel D, Panel F and Panel H, each of Panel E's side surfaces and end surfaces contain corresponding cutouts and male dovetails to facilitate such engagement.

Figure 6:
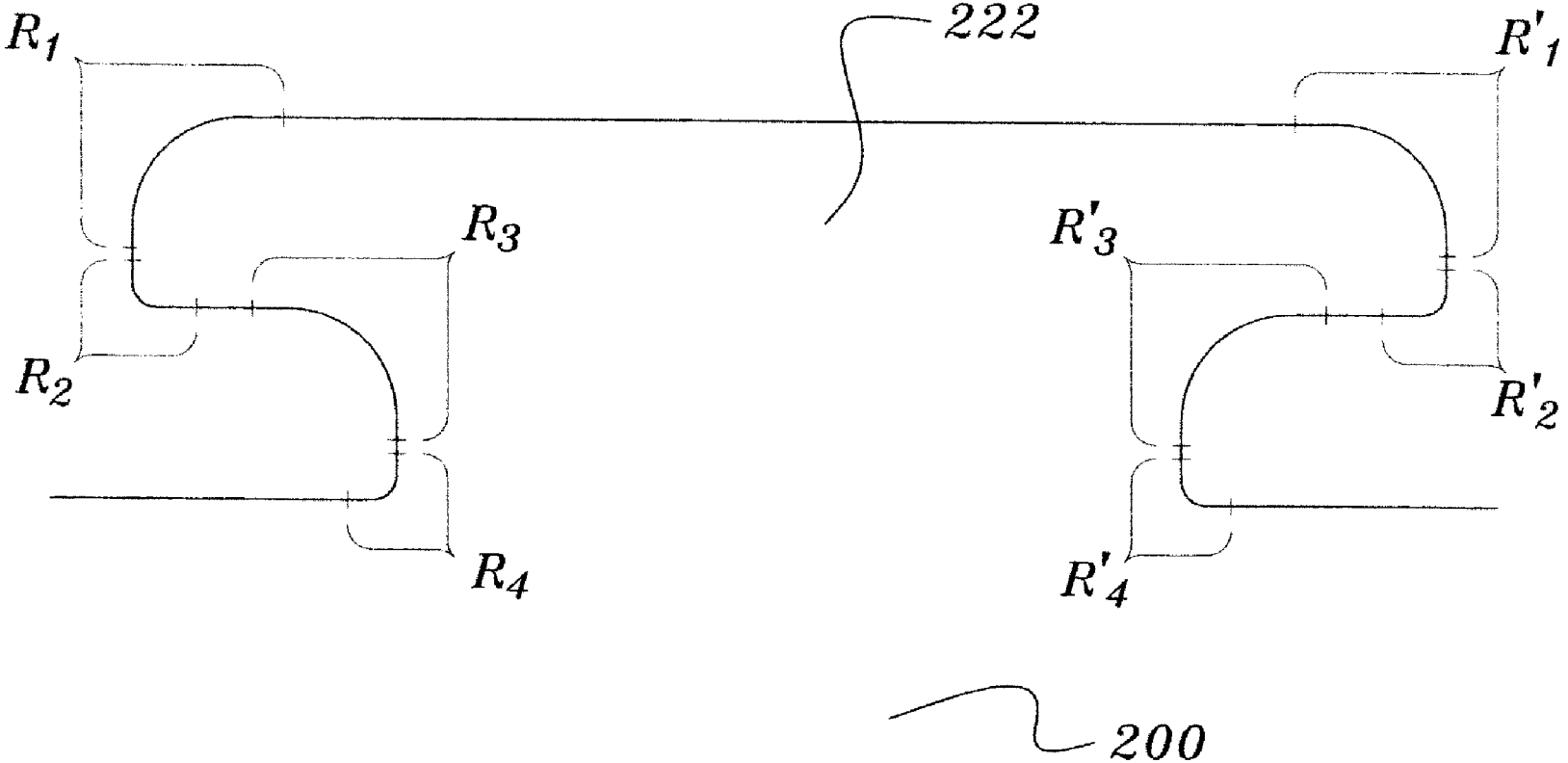
FIG. 6 is another close up view from above of a male dovetail as contemplated by the present invention.

FIG. 6 illustrates the silhouette of a male dovetail 222 as contemplated by the present invention. As previously discussed, male dovetail 222 is comprised of flanged extremities 124 and 126. Each of said flanged extremities 124 and 126 is defined by a plurality of angles formed at various radii such that male dovetail 222 and female dovetail cutout 122 fit snugly and perform as desired. As shown in FIG. 6, flanged extremity 124 is shown as being defined by four (4) radially defined angles, $R_1$, $R_2$, $R_3$ and $R_4$. In a preferred embodiment, each of radially defined angles $R_1$, $R_2$, $R_3$ and $R_4$ serve to introduce a ninety (90) degree turn in the outside perimeter of male dovetail 222, albeit at different rates of curvature. For example, as illustrated in FIG. 6, the rate of curvature illustrated in radially defined angles $R_1$ and $R_3$ is more gradual than the rate of curvature shown in radially defined angles $R_2$ and $R_4$. Different rates of curvature can be employed at radially defined angles, $R_1$, $R_2$, $R_3$ and $R_4$ in order to manipulate certain variables in the structural performance of ice panel 200. For example, larger radially defined angles, such as those at radially defined angles $R_1$ and $R_3$ provide greater structural strength to allow transverse directional expansion and contraction while smaller radially defined angles, such as those at radially defined angles $R_2$ and $R_4$ help to prevent stress cracking from developing during movement of panel 200.

As is apparent to one skilled in the art, the size of the individual radially defined angles $R_1$, $R_2$, $R_3$ and $R_4$ is expressed as a distance corresponding to the radius of the bit, blade or other implement used to cut or otherwise shape the desired angle into the desired shape. It is possible that radially defined angles $R_1$, $R_2$, $R_3$ and $R_4$ each have a different dimension, however in a preferred embodiment, radially defined angles $R_1$ and $R_3$ are of equal dimension as are radially defined angles $R_2$ and $R_4$. In a preferred embodiment, radially defined angles $R_1$ and $R_3$ have a radius of between 0.75 and 1.25 inches, with 1.00 inches being most preferred. Also, in a preferred embodiment, radially defined angles $R_2$ and $R_4$ have a radius of between 0.1875 inches and 0.375 inches with 0.25 inches being most preferred. It is possible to have radially defined angles $R_1$ and $R_3$ as well as $R_2$ and $R_4$ with differing radii within the ranges discussed, however it is preferred that the radii of radially defined angle $R_1$ equal that of radially defined angle $R_3$ and that the radii of radially defined angle $R_2$ equal that of radially defined angle $R_4$. In a preferred embodiment, the radially defined angles $R_1$, $R_2$, $R_3$ and $R_4$ illustrated on flanged extremity 124 are also present on flanged extremity 126 as radially defined angles $R'_1$, $R'_2$, $R'_3$ and $R'_4$ in identical dimension, however such identical dimensions of $R_1$, $R_2$, $R_3$, $R_4$ and $R'_1$, $R'_2$, $R'_3$ and $R'_4$ are not required.

Now that the invention has been described,

What is claimed is:

1. A synthetic ice surface system comprising:

a first synthetic ice panel having a top surface, a bottom surface, a side surface, and a second side surface having at least one expansion groove;

said side surface of said first synthetic panel having at least one expansion groove having a length dimension and a height dimension, and at least one male dovetail protrusion, said at least one male dovetail protrusion further comprises at least one flanged extremity, said flanged extremity defined by a plurality of radially defined angles;

a second synthetic ice panel having a top surface, a bottom surface, and a side surface, said side surface of said second synthetic ice panel having at least one expansion nub having a length dimension and a height dimension, and at least one female dovetail cutout such that said male dovetail protrusion engagebly connects with said female dovetail cutout; and a third synthetic ice panel having a top surface, a bottom surface, and a side surface having at least one expansion nub;

wherein said expansion groove is disposed along said side surface of said first synthetic ice panel so as to engage with said expansion nub on said side surface of said second synthetic ice panel such that the movement of said first synthetic ice panel relative to said second synthetic ice panel is inhibited; and wherein said expansion groove is disposed along said second side surface of said first synthetic ice panel so as to engage with said expansion nub on said side surface of said third synthetic ice panel such that the movement of said first synthetic ice panel relative to said third synthetic ice panel is inhibited.

2. The synthetic ice surface of claim 1 wherein at least one of said plurality of radially defined angles has a radius of between 0.75 and 1.25 inches.

3. The synthetic ice surface of claim 2 further comprising a radially defined angle with a radius of between 0.1875 and 0.375 inches.

4. The synthetic ice surface of claim 1 wherein said flanged extremity is comprised of four radially defined angles.

5. The synthetic ice surface of claim 4 wherein two of said four radially defined angles have a radius of between 0.75 and 1.25 inches and the remaining two of said four radially defined angles have a radius of between 0.1875 and 0.375 inches.

6. The synthetic ice surface of claim 5 wherein two of said four radially defined angles have a radius of 1.00 inch and the remaining two of said four radially defined angles have a radius of 0.25 inches.

* * * * *